United States Patent [19]

Ekerot et al.

[11] Patent Number: 4,897,112

[45] Date of Patent: Jan. 30, 1990

[54] METHOD FOR HEATING PRIMARILY NOZZLES, AND APPARATUS FOR CARRYING OUT THE METHOD

[75] Inventors: Sven Ekerot, Minervavägen 19,, S-191 50 Sollentuna; Jan Svennebrink, Järfälla, both of Sweden

[73] Assignee: Sven Ekerot, Sollentuna, Sweden

[21] Appl. No.: 213,612

[22] PCT Filed: Dec. 29, 1986

[86] PCT No.: PCT/SE86/00588

§ 371 Date: Jun. 27, 1988

§ 102(e) Date: Jun. 27, 1988

[87] PCT Pub. No.: WO87/04100

PCT Pub. Date: Jul. 16, 1987

[30] Foreign Application Priority Data

Dec. 30, 1985 [SE] Sweden ..... 8506160

[51] Int. Cl.[4] ..... C21C 5/42; C22B 4/00

[52] U.S. Cl. ..... 75/10.13; 266/237

[58] Field of Search ..... 75/10.13; 266/237

[56] References Cited

U.S. PATENT DOCUMENTS 3,847,202 11/1974 Vaughn et al. ..... 164/50

4,023,783 5/1977 Moreau ..... 266/237

4,769,066 9/1988 Eidem ..... 266/237

FOREIGN PATENT DOCUMENTS 2122859 1/1984 United Kingdom .

*Primary Examiner*—Peter D. Rosenberg

*Attorney, Agent, or Firm*—Nies, Webner, Kurz & Bergert

[57] ABSTRACT

A method for heating primarily a so-called nozzle (2) through which a hot medium (10) in a liquid phase or in a liquid phase like condition, such as a molten metal, e.g. molten steel, is intended to pass in conjunction with a casting or molding operation for example.

The method is particularly characterized in that the nozzle (2) is pre-heated prior to being brought into contact with the medium (10) and/or is heated at least periodically while medium is passing through the nozzle. Heating of the nozzle is effected with the aid of microwaves and the nozzle includes material which exhibits a significant loss factor with regard to microwaves. The nozzle is heated preferably for the purpose of avoiding blockages and the like from occurring in the nozzle as a result of a temperature decrease in the medium passing therethrough.

The invention also relates to apparatus for carrying out the method.

24 Claims, 2 Drawing Sheets

METHOD FOR HEATING PRIMARILY NOZZLES, AND APPARATUS FOR CARRYING OUT THE METHOD

The present invention relates to a method for heating primarily so-called nozzles of the kind through which a hot medium in liquid phase or in a liquid phase like condition such as molten metal, e.g. molten steel, is intended to pass.

A hot medium of this kind which is intended to exit from a so-called nozzle or like device through an exit orifice provided therein and which medium shall be maintained at a pronounced elevated temperature may undergo radical local cooling as it passes through the nozzle, due to the lower temperature of the nozzle. This local cooling of the medium can give rise to serious disturbances in operation, such as blocking of the nozzle etc.

This problem can be solved by heating the medium to a given over-temperature. Over-heating of the medium, however, is often unsuitable, inter alia for practical reasons. Another solution is one which involves pre-heating the nozzle, which is effected by indirect heating methods when practicing known techniques. It is difficult to pre-heat the nozzles in this way, however, while at the same time taking into consideration the technical requirements placed on the nozzle with regard to mechanical strength and material.

The present invention relates to a method and apparatus with which the aforesaid problems are substantially solved. According to preferred embodiments the nozzle can be heated when metal runs through a nozzle and when no metal is present in the nozzle outlet passage.

Thus, the invention relates to a method for heating primarily a so-called nozzle through which a hot medium in liquid phase or in a liquid phase like condition, such as molten metal, e.g. molten steel, is intended to pass in conjunction with casting or molding operations.

The method is particularly characterized by pre-heating the nozzle with the aid of microwaves prior to bringing the medium into contact with the nozzle and/or at least periodically while medium is passing therethrough, said nozzle incorporating material which exhibits a significant loss factor with regard to microwaves, and said heating being effected preferably in order to prevent blockages or the like occurring in the nozzle as a result of a temperature decrease in the medium passing through the nozzle.

The invention also relates to apparatus for heating primarily a so-called nozzle through which hot medium in liquid phase, or in a liquid phase like condition such as molten metal, e.g. molten steel, is intended to pass in conjunction with a casting or molding operation.

The apparatus is particularly characterized in that devices are provided for pre-heating the nozzle with the aid of microwaves prior to bringing the medium into contact with the nozzle and/or for heating the nozzle at least periodically during passage of the medium therethrough, said nozzle incorporating material which exhibits a significant loss factor with regard to microwaves, and said heating being effected preferably in order to avoid blockages and the like from occurring in the nozzle as a result of a temperature decrease in the medium passing therethrough.

The invention will now be described in more detail with reference to an exemplifying embodiment thereof and with reference to the accompanying drawings, in which FIG. 1 is a schematic, central, vertical sectional view of a first embodiment of a central part of apparatus according to the invention, used in conjunction with a casting operation;

Figure 1:
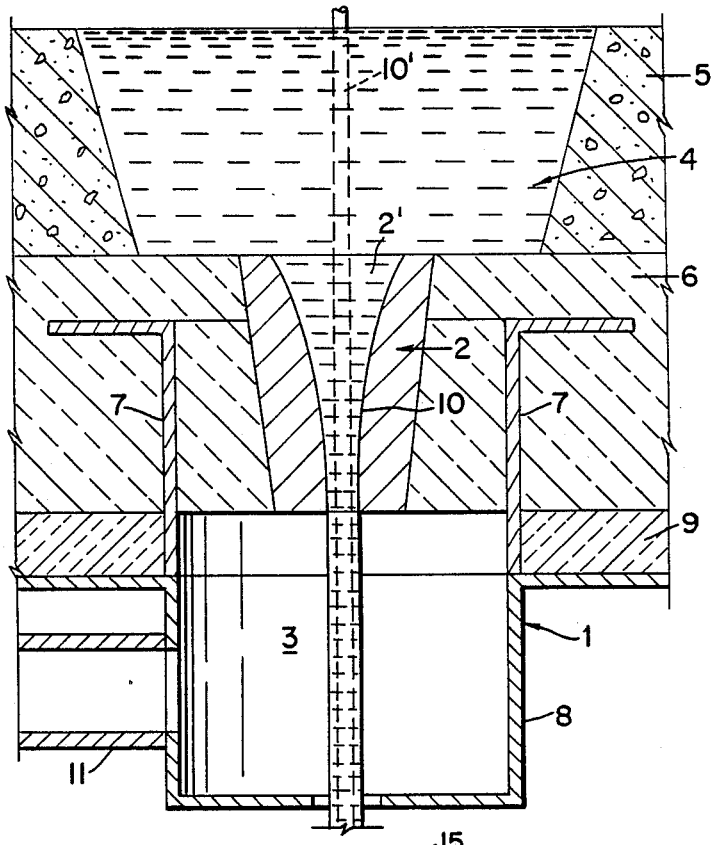

The apparatus illustrated in FIG. 1 includes a microwave applicator 1 intended for heating a nozzle 2, said nozzle comprising a dielectric material exhibiting a significant loss factor with regard to microwaves and thus being heated by microwaves supplied thereto. The applicator 1 forms a microwave cavity 3.

The reference 4 in FIG. 1 identifies the opening of a container vessel 5, to which the nozzle 2 is connected, the nozzle being embodied in and therewith surrounded by a ceramic material 6, which preferably exhibits an extremely small loss factor, for instance solely $Al_2O_3$. It is preferred in many cases that parts of the cavity are formed by means of metallic parts 7, such as parts 7 of a metallic net, for example a net comprising platinum wire, embodied in, such as cast in the ceramic material surrounding the nozzle 2. In the illustrated embodiment the cavity 3 presents a downwardly widening metallic part 8. Supplementary parts 9 of insulating brick or the like may be required in many instances, in order to obtain a suitable arrangement.

As beforementioned, a hot medium 10 in liquid phase or in a liquid phase like condition, such as molten metal 10, e.g. molten steel 10, is intended to pass through the nozzle 2, for instance in a casting or molding operation.

According to preferred embodiments of the invention the cavity 3 necessary for microwave heating processes is constructed so that the nozzle 2 can be heated both when metallic medium passes through the nozzle and also substantially in the absence of metallic medium in said nozzle, and so that in this regard mutually different oscillating modes can be applied, depending on the presence or absence of metallic medium.

The cavity 3 has a substantially circular cross-section, in a plane extending at right angles to the longitudinal axis of the nozzle, i.e. to the direction in which the through-passage 2' of the nozzle extends therethrough when the nozzle is mounted in the cavity in the manner intended. The reference 11 identifies a waveguide extending substantially radially into the cavity for supplying microwaves, said waveguide preferably having a rectangular cross-sectional shape. The cavity is preferably constructed to oscillate in a coaxial mode, a first mode, when metallic medium is present in the nozzle, and in a second mode when substantially no metallic medium is present in the nozzle. In this regard, the cavity is preferably constructed so that said second mode is a cylindrical oscillating mode, preferably a mode, such as TM 010, whose resonance frequency is independent of the length of the cavity, while the diameter is determined by the resonance frequency. The cavity preferably has a length which corresponds essentially to half the wavelength of the intended microwaves. Thus, in some of the preferred cases the diameter and the length of the cavity are determined by the two oscillating modes per se. In some instances the mode TM 010 is written as $TM_{010}$ instead.

Figure 2:
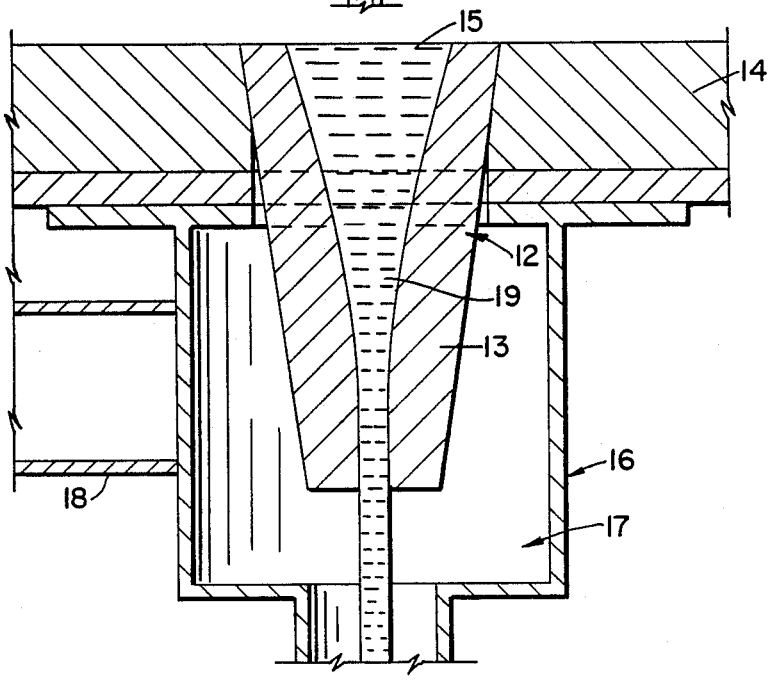
FIG. 2 illustrates schematically a second embodiment of a central part of an apparatus according to the invention, in conjunction with a casting operation.

In the embodiment illustrated in FIG. 2 the nozzle 12 includes a free, outwardly projecting part 13 which extends down from the opening 15 of a container vessel 14. A microwave applicator 16 is arranged to form a cavity 17 having preferably a substantially cylindrical cross-section at right angles to the direction in which the nozzle part 13 extends, said nozzle part protruding into the cavity 17. The reference 18 identifies a waveguide corresponding to the waveguide 11 in FIG. 1. With regard to oscillating modes, the applicator etc. illustrated in FIG. 2 is preferably constructed in the manner of the applicator illustrated in FIG. 1, i.e. so that the nozzle 2 can be heated irrespective of whether molten metal 19 or the like flows therethrough or not.

Figure 3:
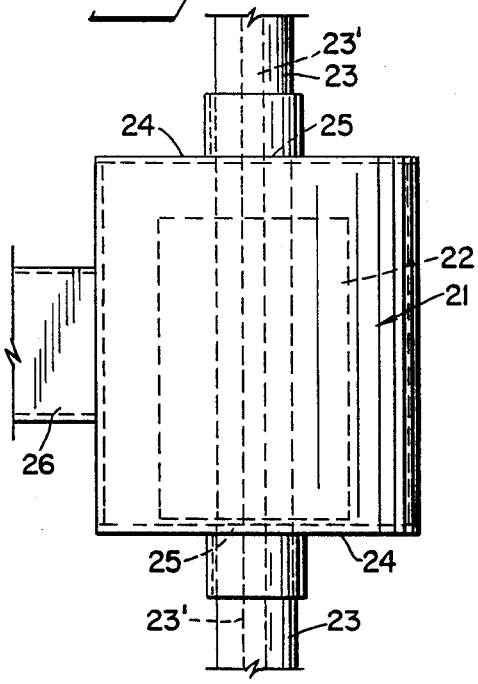
FIG. 3 illustrates schematically a third embodiment of an apparatus according to the invention, seen in side view.
Figure 4:
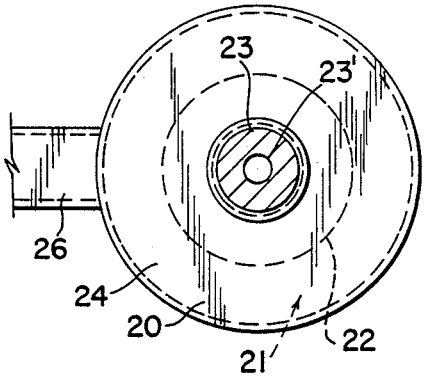
FIG. 4 illustrates the apparatus shown in FIG. 3 from beneath in said Figure.

In the embodiment illustrated in FIGS. 3 and 4 the microwave applicator 20 incorporated in the apparatus is not connected directly to a container vessel or the like. A cavity 21 formed by means of the applicator accommodates a nozzle 22 through which medium of the aforesaid kind is intended to be passed for, e.g., shaping purposes, such as surface smoothing purposes, wherewith the medium may be in the form of an elongated object 23, which is either homogenous or hollow tubular or derplex having a central material part 23', as illustrated in FIGS. 1 and 2. According to preferred embodiments, the applicator 20, similar to the applicators described above with reference to FIGS. 1 and 2, is constructed to oscillate in modes which enable the nozzle 22 to be heated irrespective of whether metallic material is passing therethrough or not. The reference 24 identifies two end covers provided with apertures 25, while the reference 26 identifies a microwave feed waveguide that extends substantially radially to the cavity.

Figure 5:
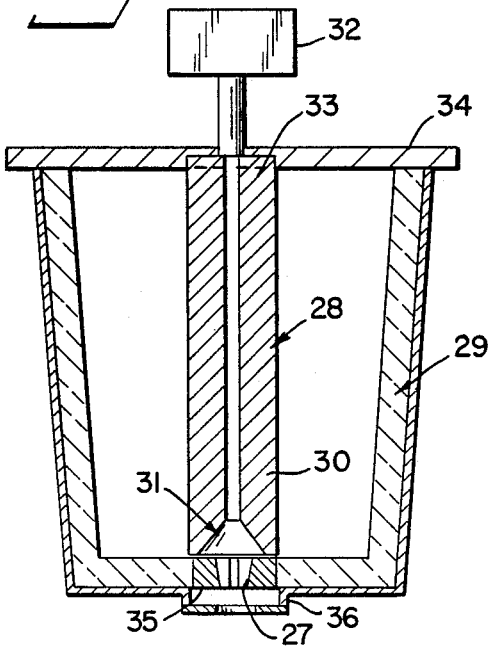
FIG. 5 is a central, vertical sectional view illustrating schematically an embodiment of the apparatus by means of which a nozzle is intended to be heated from the inside of a container vessel.

FIG. 5 illustrates an arrangement which is intended particularly for heating a nozzle 27 comprising a ceramic material which exhibits a significant loss factor and which is intended to be heated by microwaves. Auxiliary devices comprising a substantially cylindrical waveguide 28 for microwaves are arranged to be inserted into a container vessel 29, such as a ladle, and to be connected at one end part 30 thereof to the nozzle 27, this end part of the waveguide 28 contributing towards forming a cavity 31, in accordance with one embodiment of the invention. With regard to temperature influence, the waveguide 28 may be cooled in some suitable manner, e.g. water cooled, and may be covered externally with an insulating material. The reference 32 identifies a microwave generator which is connected to the upper part 33 of the waveguide. The reference 34 identifies a metallic lid. The nozzle is conveniently embraced by a bush 35 made of a material which will not be heated to any appreciable extent by microwaves. Located beneath the nozzle is a guard 36, preferably a metallic guard, which protects against leakage of microwaves. Embodiments are also conceivable in which the waveguide, substantially having the construction shown in FIG. 5 has an antenna affect and contributes towards transmitting microwaves to the nozzle without cooperating in forming a cavity to this end. The material incorporated in the nozzle, such as 2, 12, 27, to be heated in accordance with the invention is selected in accordance with the use for which the nozzle is intended. In the case of molten metal, such as molten steel, the nozzle is suitably made of a ceramic material. In this regard, the nozzle comprises a ceramic material that exhibits a significant loss factor with regard to microwaves, such as $ZrO_2$, this ceramic material preferably forming those parts of the nozzle that come into contact with the molten medium.

It will be understood, however, that in other cases the nozzle may comprise or consist of some other dielectric material that can be heated effectively with microwaves.

The method according to the invention and the manner in which the apparatus according to the invention operates will be understood in all essentials from the aforegoing. Thus, the nozzle is heated directly with the aid of microwaves prior to hot medium being passed through the nozzle and/or while hot medium is passing through said nozzle, thereby providing a flexible and particularly useful heating arrangement. At least in those instances when a change is made between operational heating modes commensurate with the situation in which molten medium runs through the nozzle and the situation in which substantially no molten medium is present in said nozzle, the conditions under which microwave heating is effected, these conditions also requiring the commensurate formation of the microwave cavity necessary for heating purposes, are suitably adapted in a manner which enables heating to be effected in both of said heating situations, there being employed a first oscillating mode when molten medium flows through the nozzle and a second, different oscillating mode when substantially no molten medium is present in the nozzle. This enables the microwave heating apparatus to be used in both of the aforesaid heating situations, which is an essential step forward with regard to known applicator designs, which afford effective heating in only one of the aforesaid situations.

It will be understood from the aforegoing that the invention affords important advantages. In the aforegoing the invention has been described with reference to a number of exemplifying embodiments thereof. It will be understood, however, that other embodiments are conceivable, and that minor modifications can be made without departing from the concept of the invention.

For example, a plurality of nozzle materials or nozzle components are embraced within the framework of the overall function, i.e. the ability of the material to be heated with the aid of microwaves. Zirconium dioxide ($ZrO_2$) is one example of a suitable ceramic material for ceramic nozzles or for ceramic nozzle components.

With regard to the composition of the ceramic materials that are to be heated with the aid of microwaves, measurements have shown that the majority of ceramic materials with solely minor modifications to the composition thereof can be used when heating in accordance with the invention. Suitable materials have been found to be ceramic materials based on $ZrO_2$ or $Al_2O_3$ supplemented with some other oxidic material or materials, such as MgO, $SiO_2$, $Fe_2O_3$. Extraordinary possibilities are to be found for controlling heating through the selection of material exhibiting mutually different loss factors, and by mixing mutually different components, e.g. ceramic components. The material from which the nozzle is made or from which parts of the nozzle are made is selected in this regard.

As will be understood from the aforegoing, the invention can be applied in many different fields. The so-called nozzle may, for example, comprise a shaping tool, e.g. a matrix or die in the extrusion of metal profiles, such as tubular profiles or other hollow profiles. The nozzle may also constitute a tool for the direct casting of wire rod, essentially in accordance with Swedish Patent Specification No. 8003487-9, in which case heating of the nozzle, or die, is preferably effected in the form of a nozzle pre-heat prior to passing molten medium therethrough, and as back-up heat during a casting operation, thereby controlling the temperature of the nozzle, for example, in order to prevent blockages from occurring therein. The embodiment illustrated in FIG. 1 also has a stabilizing wire 10' extending through the nozzle. As will be understood from the aforegoing, additional fields in which the invention can be applied include nozzle heating processes, both preheating and back-up heating, in more general casting operations, such as continuous casting operations.

Applications are also conceivable in which the aforesaid medium is, for instance, a plastics material. The invention is therefore not limited to metallic materials, such as steel.

When the space presented between the nozzle and the external casing in the case of embodiments according to FIG. 3 is occupied by a ceramic material, this material will exhibit a very low loss factor with regard to microwaves.

Consequently, the invention is not restricted to the aforedescribed embodiments and modifications can be made within the scope of the following claims.

We claim:

1. A method for heating so-calling nozzles through which steel in some form of liquid phase condition is intended to pass in a forming operation, comprising the step of heating, with the aid of microwaves, the nozzle (2, 12, 22, 27) combined with the step of constructing the nozzle with material that exhibits a high loss factor with regard to microwaves, said microwave heating being effected for the purpose of avoiding blockages from occurring in the nozzle as a result of a temperature decrease in the hot medium passing therethrough.

2. A method according to claim 1, wherein the nozzle material that exhibits a high loss factor comprises a ceramic material, such as $ZrO_2$.

3. A method according to claim 1, wherein the conditions under which said microwave heating takes place, which includes the forming of the microwave cavity (3, 17, 21, 31) necessary for the heating process, are adapted to enable heating of the nozzle, both when metallic medium passes through the nozzle and when substantially no metallic medium is present therein, there being used mutually different oscillating modes in the presence of a metallic medium in the nozzle and in the absence of a metallic medium in the nozzle, respectively.

4. A method according to claim 3, wherein said conditions are adapted so said cavity oscillates in a coaxial mode, a first mode, when metallic medium passes through the nozzle, and in a second mode when substantially no metallic medium is present in the nozzle.

5. A method according to claim 4, wherein said second mode is a cylindrical mode, preferably a mode, such as TM 010, whose resonance frequency is independent of the length of the cavity.

6. A method according to claim 1, wherein the medium passing through the nozzle forms, at least periodically, a composite (23) with a solid metallic body (10') which is caused to pass through the nozzle.

7. A method according to claim 1, wherein the nozzle is heated to a given over-temperature, whereby said medium is heated during its passage through the nozzle.

8. A method according to claim 1, wherein the material from which the nozzle or parts thereof is, comprised is caused to exhibit a so-called loss factor with regard to micro-waves suitable for the intended purpose, by mixing together different ceramic components suitable herefor.

9. Apparatus for heating a so-called nozzle through which steel in some form of liquid phase condition is intended to pass in a metallurgical process operation, comprising devices (1, 11, 16, 18, 20, 26, 28) adjacent the nozzle for heating the nozzle (2, 12, 22, 27) with and without hot medium being present in the nozzle; said devices being arranged to effect said heating with the aid of microwaves; and said nozzle incorporating material that exhibits a high loss factor with regard to microwaves, said heating being effected for the purpose of avoiding blockages and the like from occuring in the nozzle as a result of a temperature decrease in the medium passing through said nozzle.

10. Apparatus according to claim 9, wherein the material exhibiting a high loss factor is a ceramic material, such as $ZrO_2$.

11. Apparatus according to claim 9, wherein said derives include a microwave cavity (3,17,21) required for microwave heating purposes, which is constructed in a manner which enables the nozzle to be heated both when metallic medium passes through the nozzle and when substantially no metallic medium is present in said nozzle, there being used to this end, different oscillating modes when metallic medium passes through the nozzle and when substantially no metallic medium present therein.

12. Apparatus according to claim 11, wherein said microwave cavity is constructed to oscillate in a coaxial mode, a first mode, when metallic medium is present in the nozzle and in a second mode when substantially no metallic medium is present in said nozzle.

13. Apparatus according to claim 12, wherein said microwave cavity has a construction which provides that said second mode is a cylindrical mode, such as TM 010, whose resonance frequency is independent of the length of the cavity, and wherein the diameter of said cavity is determined by the resonance frequency.

14. Apparatus according to claim 9, wherein at least a part of said nozzle is embodied in, and therewith surrounded by, a ceramic material (6) which exhibits very small loss factor, and parts of the cavity are formed by means of metallic parts (7) combined in the ceramic material surrounding the nozzle.

15. Apparatus according to claim 9, wherein said nozzle includes a free outwardly projecting mouth part (13) and at least one of said devices adjacent said nozzle is a microwave cavity (17) which surrounds said free outwardly projecting mouth part.

16. Apparatus according to claim 9, including a container vessel and wherein a said device comprises a substantially tubular waveguide (28) for microwaves arranged to connect at one end part (30) thereof with said nozzle, by insertion into said container vessel (29) wherein said nozzle is a bottom nozzle (27), such that said one end part (30) of said wave guide co-acts to form a microwave cavity required for heating the nozzle; and auxiliary parts separate from the waveguide and located in the vicinity of the nozzle, supplement the waveguide to form said cavity.

17. Apparatus according to claim 9, wherein said ceramic nozzle material to be heated with the aid of microwaves, is a ceramic material based on a selected oxide from the group consisting of $ZrO_2$ and $Al_2O_3$ and supplemented with at least one of some other oxidic material selected from the group consisting of MgO, $SiO_2$ and $Fe_2O_3$.

18. A method for heating nozzles as defined in claim 1, wherein the step of heating the nozzle with microwaves occurs prior to bringing the medium into contact with the nozzle.

19. A method for heating nozzles as defined in claim 1, wherein the step of heating the nozzle with microwaves occurs at least periodically during passage of said medium through the nozzle.

20. A method for heating nozzles as defined in claim 1, wherein the step of heating the nozzles with microwaves includes both a pre-heating of the nozzle prior to bringing the medium into contact with the nozzle and subsequent heating of the nozzle at least periodically with microwaves during passage of said medium through the nozzle.

21. Apparatus as defined in claim 9, for heating a nozzle wherein said means for heating the nozzle by microwave includes means for pre-heating the nozzle by microwaves prior to the nozzle being contacted by the hot medium, and means for at least periodically heating the nozzle by microwaves while the hot medium is passing through the nozzle.

22. Apparatus according to claim 14, wherein said metallic parts comprise a metallic net.

23. Apparatus according to claim 14 wherein said metallic parts are cast in the ceramic material surrounding said at least a part of said nozzle.

24. Apparatus according to claim 16, wherein said auxiliary parts are constructed to provide an antenna effect to contribute toward transmission of microwaves to the nozzle.

* * * * *

UNITED STATES PATENT AND TRADEMARK OFFICE

CERTIFICATE OF CORRECTION

PATENT NO. : 4,897,112

DATED : January 30, 1990

INVENTOR(S) : SVEN EKEROT et al

It is certified that error appears in the above-identified patent and that said Letters Patent is hereby corrected as shown below:

IN THE CLAIMS:

Claim 8, Column 6, line 5, cancel the comma (,).

Claim 11, Column 6, line 27, change "derives" to --devices--.

Signed and Sealed this

Fifteenth Day of January, 1991

*Attest:*

HARRY F. MANBECK, JR.

*Attesting Officer*

*Commissioner of Patents and Trademarks*